US006068122A

United States Patent [19]

Burns et al.

[11] Patent Number: 6,068,122

[45] Date of Patent: May 30, 2000

[54] TRAVEL POUCH FOR HEATED APPLIANCES

[76] Inventors: Charles R. Burns; Betty J. Gwizdak, both of 2205 Fairview Rd., Stockbridge, Ga. 30281

[21] Appl. No.: 09/313,204

[22] Filed: May 18, 1999

[51] Int. Cl.[7] ..... B65D 33/14

[52] U.S. Cl. ..... 206/372; 383/24; 383/86

[58] Field of Search ..... 206/349, 372, 206/576, 320; 383/33, 62, 86, 110, 14, 24

[56] References Cited

U.S. PATENT DOCUMENTS

| | | | |
|---|---|---|---|
| D. 350,230 | 9/1994 | O'Brien . | |
| D. 365,441 | 12/1995 | Drake, et al. . | |
| 4,360,984 | 11/1982 | Ruttenberg . | |
| 4,570,792 | 2/1986 | Conway . | |
| 4,621,003 | 11/1986 | O'Kane . | |
| 4,660,610 | 4/1987 | McIntire III . | |
| 4,966,318 | 10/1990 | Dutka | 383/86 |
| 4,973,019 | 11/1990 | Baird et al. . | |
| 5,141,189 | 8/1992 | Andrew . | |
| 5,266,772 | 11/1993 | Reed . | |
| 5,577,607 | 11/1996 | Drake et al. . | |
| 5,638,955 | 6/1997 | Calciano | 206/349 |
| 5,950,826 | 9/1999 | Lykowski | 206/349 |

*Primary Examiner*—Jim Foster
*Attorney, Agent, or Firm*—Richard C. Litman

[57] ABSTRACT

A travel pouch for heated appliances is made from an elongated rectangular strip of material having three layers: an outer layer made from a decorative, flexible fabric; a middle layer made from a thermal insulative batting or padding; and an inner layer made from a flexible fabric coated with a heat resistant material, the inner layer being permanently fastened to the outer layer about its periphery to enclose the middle layer. About one third of the strip is folded and permanently fastened along the sides to form a pouch or pocket, the inside of the pocket being lined by the inner layer. The remaining one-third of the strip forms a flap. The flap may be folded in one direction to cover the pocket, being temporarily fastened with hook and loop fastening material, or it may be folded in the opposite direction and hung on a rod, being secured by hook and loop fastening material to provide access to the appliance. An elastic strap is fastened to the inside of the flap above the pocket to support the appliance's power cord outside the pocket.

16 Claims, 5 Drawing Sheets

TRAVEL POUCH FOR HEATED APPLIANCES

BACKGROUND OF THE INVENTION

1. Field of the Invention

The present invention relates to storage containers for heated appliances, such as curling irons and small travel irons, and particularly to a heat resistant travel pouch for storing such appliances in luggage.

2. Description of the Related Art

It is frequently necessary or desirable to use a heated appliance, such as a curling iron or a small travel iron, while traveling. Often, the exigencies of travel do not permit sufficient time to allow the heated appliance to cool to room temperature before the appliance must be packed in a suitcase. It is therefore desirable to have a heat resistant travel pouch in which such appliances may be stowed for packing in luggage. Particularly in the case of curling irons, it is further desirable that such a travel pouch be adapted for conveniently storing the appliance at a location in a hotel or motel room where the appliance is likely to be used, viz., a bathroom equipped with a mirror. Several devices have been proposed for addressing these problems.

U.S. Des. Pat. No. 350,230, issued Sep. 6, 1994 to C.S. O'Brien, shows a curling iron cover resembling a sheath for carrying a single curling iron. The cover has a planar back and what appears to be rigid front and sides projecting from the back and forming a pocket which is open at the top and tapers to a narrow bottom. There appears to be a strap above the open top of the pocket.

U.S. Design Pat. No. 365,441, issued Dec. 26, 1995 to Drake et al., shows a curling iron pouch having a snap fastener, the top being open on either side of snap. The same device is described in U.S. Pat. No. 5,577,607, issued Nov. 26, 1996. The patent teaches that the pouch has a multi-layered construction, including two outer layers of a heat resistant nylon fabric and an inside layer of nonflammable, nonwoven, insulative batting material.

U.S. Pat. No. 4,570,792, issued Feb. 18, 1986 to K. S. Conway, teaches a travel case for curling irons in the form of a sheath composed of three layers,including an inner layer of a silicone sealed fabric used for ironing board covers, an outer layer made of a flexible material, and an intermediate layer of batting. The sheath has a flap which closes over the open end of the sheath and is secured by VELCRO. The power cord is secured by a ribbon which wraps around the sheathe and is secured by snaps or by a knot.

U.S. Pat. No. 4,973,019, issued Nov. 27, 1990 to Baird, et al., discloses an apparatus which includes a pair of spaced apart cylinders for holding curling irons which are mounted to a wall by a support bracket. U.S. Pat. No. 5,141,189, issued Aug. 25, 1992 to D.R. Andrew, teaches a curling iron holder with metallic base members which may be fastened to a wall or other fixed surface. The holder has a spring clip for holding the handle of the iron and a metallic heat shield or partial sleeve which surrounds the hot curling iron barrel without touching the barrel.

Less relevant devices include portable ironing pads, such as those disclosed in U.S. Pat. No. 4,360,984, issued Nov. 30, 1982 to Ruttenberg (an ironing pad with a cover sewn to a film-foam polymer laminate) and U.S. Pat. No. 4,621,003, issued Nov. 4, 1986 to S. O'Kane (multi-layer pad having six layers of material), and pouches for carrying welding torches or electrodes, such as those described in U.S. Pat. No. 4,660,610, issued Apr. 28, 1987 to D. L. McIntire III (pouch having three layers, two being made from canvas duck for strength and rigidity, and a middle layer of fiber-glass batting) and U.S. Pat. No. 5,266,772, issued Nov. 30, 1993 to T. M. Reed (pouch with inner and outer receptacles made of suede leather).

None of the above inventions and patents, taken either singularly or in combination, is seen to describe the instant invention as claimed. Thus a travel pouch for heated appliances solving the aforementioned problems is desired.

SUMMARY OF THE INVENTION

The travel pouch for heated appliances is a pouch made from an elongated rectangular strip of material having three layers: an outer layer made from a decorative, flexible fabric; a middle layer made from a thermal insulative batting or padding; and an inner layer made from a flexible fabric coated with a heat resistant material, the inner layer being permanently fastened to the outer layer about its periphery to enclose the middle layer. About one third of the strip is folded and permanently fastened along the sides to form a pouch or pocket, the inside of the pocket being lined by the inner layer. The remaining one-third of the strip forms a flap. The flap may be folded in one direction to cover the pocket, being temporarily fastened with hook and loop fastening material, or it may be folded in the opposite direction and hung on a rod, being secured by hook and loop fastening material to provide access to the appliance. An elastic strap is fastened to the inside of the flap above the pocket to support the appliance's power cord outside the pocket.

Accordingly, it is a principal object of the invention to provide a travel pouch for heated appliances which has a pocket lined with heat resistant material so that an appliance may be stored in the pocket and packet in luggage without the risk of fire or damage to the contents of the luggage.

It is another object of the invention to provide a travel pouch for heated appliances having a flap which covers the heated appliance and is secured by quick and strong fastening material to ensure that the heated appliance does not become accidentally dislodged from the travel pouch.

It is a further object of the invention to provide a travel pouch with a pocket for storing a heated appliance which has means for securing the appliance's power cord outside of the pocket containing the heated appliance in order to prevent damage to the power cord.

Still another object of the invention is to a travel pouch for heated appliances which may be hung temporarily on a towel bar or other support rod with the pocket flap open in order to provide storage and quick access to the appliance.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
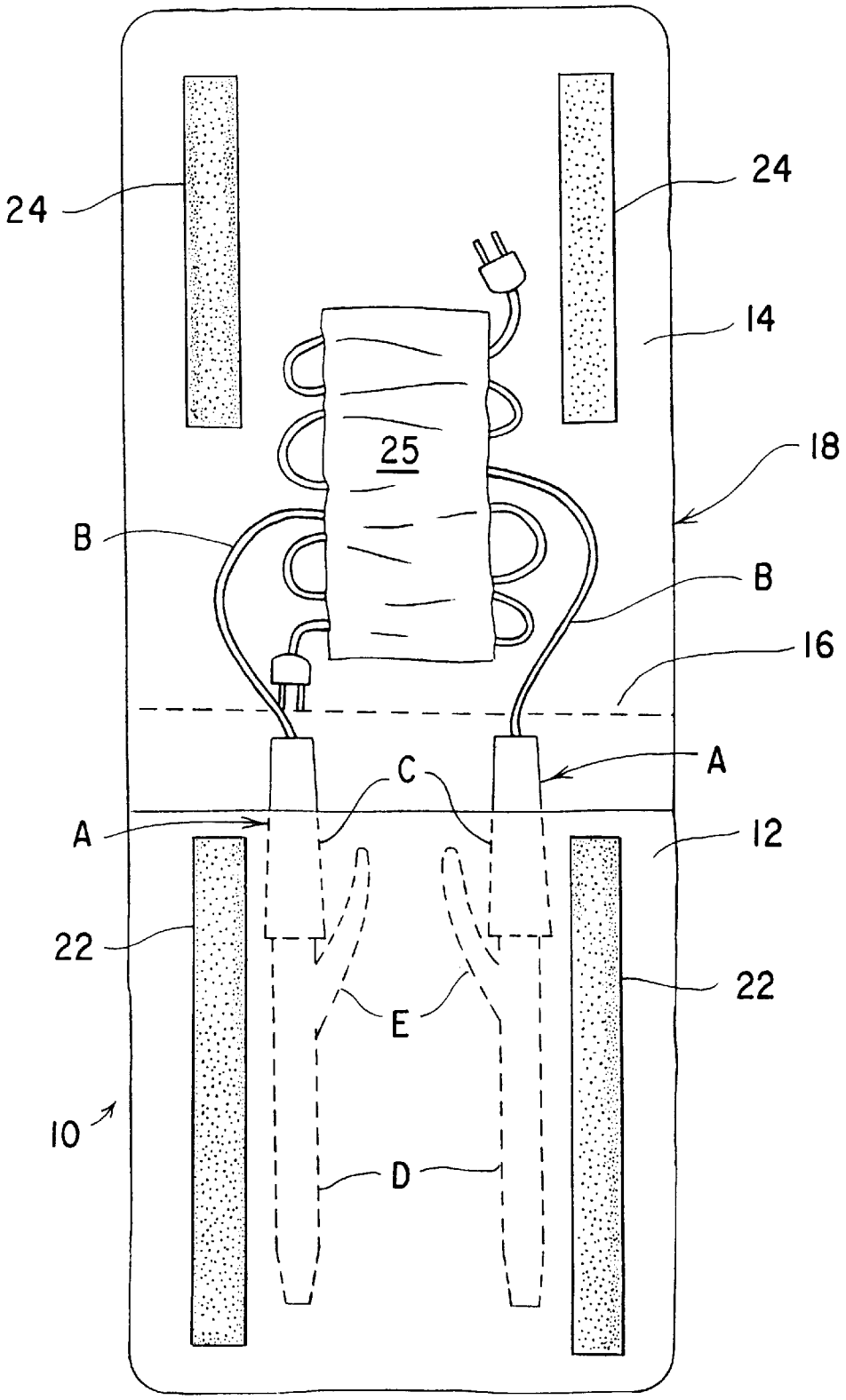
FIG. 1 is an environmental, front view of a travel pouch for heated appliances according to the present invention.

The present invention is a travel pouch for heated appliances, designated generally as 10 in the drawings. The pouch 10 may be used to store one or more curling irons A, as shown in FIG. 1, or a small travel iron for ironing clothes, or other heated appliances. In FIG. 1, the pouch 10 is shown with the flap 14 open in order to illustrate the manner of storing the curling iron power cord B.

Figure 2:
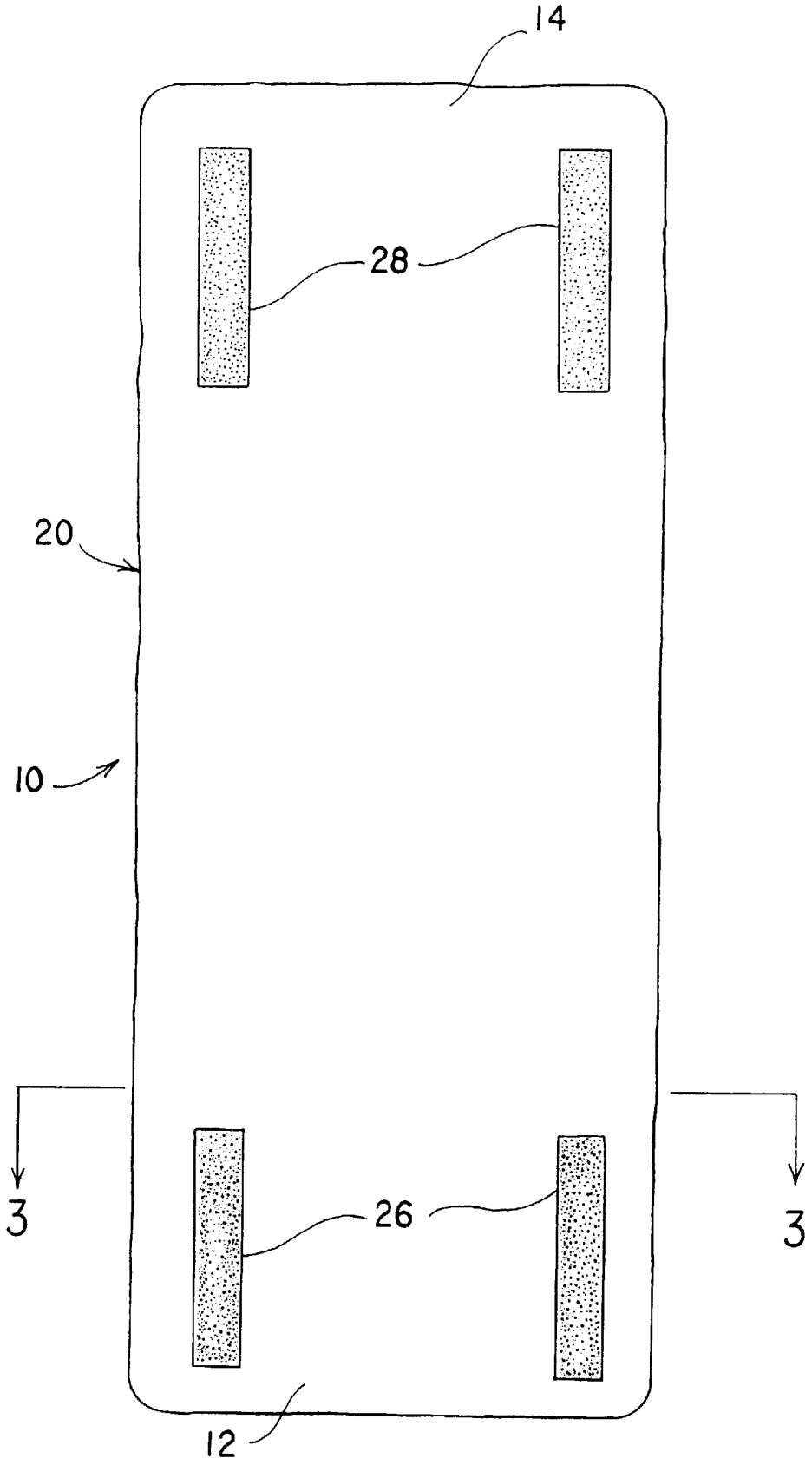
FIG. 2 is a rear view of a travel pouch for heated appliances according to the present invention.

The pouch 10 is generally rectangular in shape, having a front, or inner face 18, shown in FIG. 1, and a rear, or outer face 20, shown in FIG. 2. The pouch 10 has a pocket 12 defined on the inner face 18 and an integral flap 14 which folds about a center line 16 and is secured to the pocket 12, preferably by hook and loop fastening material, such as Velcro®. In the embodiment shown in FIG. 1, the pouch 10 has a pair of elongated, spaced apart strips of hook material 22 extending longitudinally fixedly attached to the front face of the pocket 12, and a pair of corresponding spaced apart strips of loop material 24 fixedly attached to the front face of the flap 14. The inner face of the flap 14 also has a power cord retainer 25, preferably a broad strip of elastic fabric, fixedly attached thereto.

The curling iron A generally includes a handle C made from a thermally insulated material, generally some form of plastic, a metal barrel D housing a heating element, and a spring clip E for clamping hair to the heated barrel D during curling. As shown in FIG. 1, the dimensions of the pocket 12 are such that the curling iron A may be inserted into the pocket 12 barrel D first, the length of the pocket 12 permitting the entire barrel D and the spring clip E to be disposed entirely within the pocket 12, the top of the handle C extending out of the pocket 12. The pocket 12 may be made in various sizes, and thus may be made narrow enough to accommodate only one curling iron A. In a preferred embodiment, the pocket 12 is wide enough to accommodate two curling irons A, measuring about 9.5 inches long by 8.5 inches wide. As made for a travel iron, the pocket 12 may be somewhat larger, representative dimensions being about nine inches wide by about ten inches long.

Figure 4:
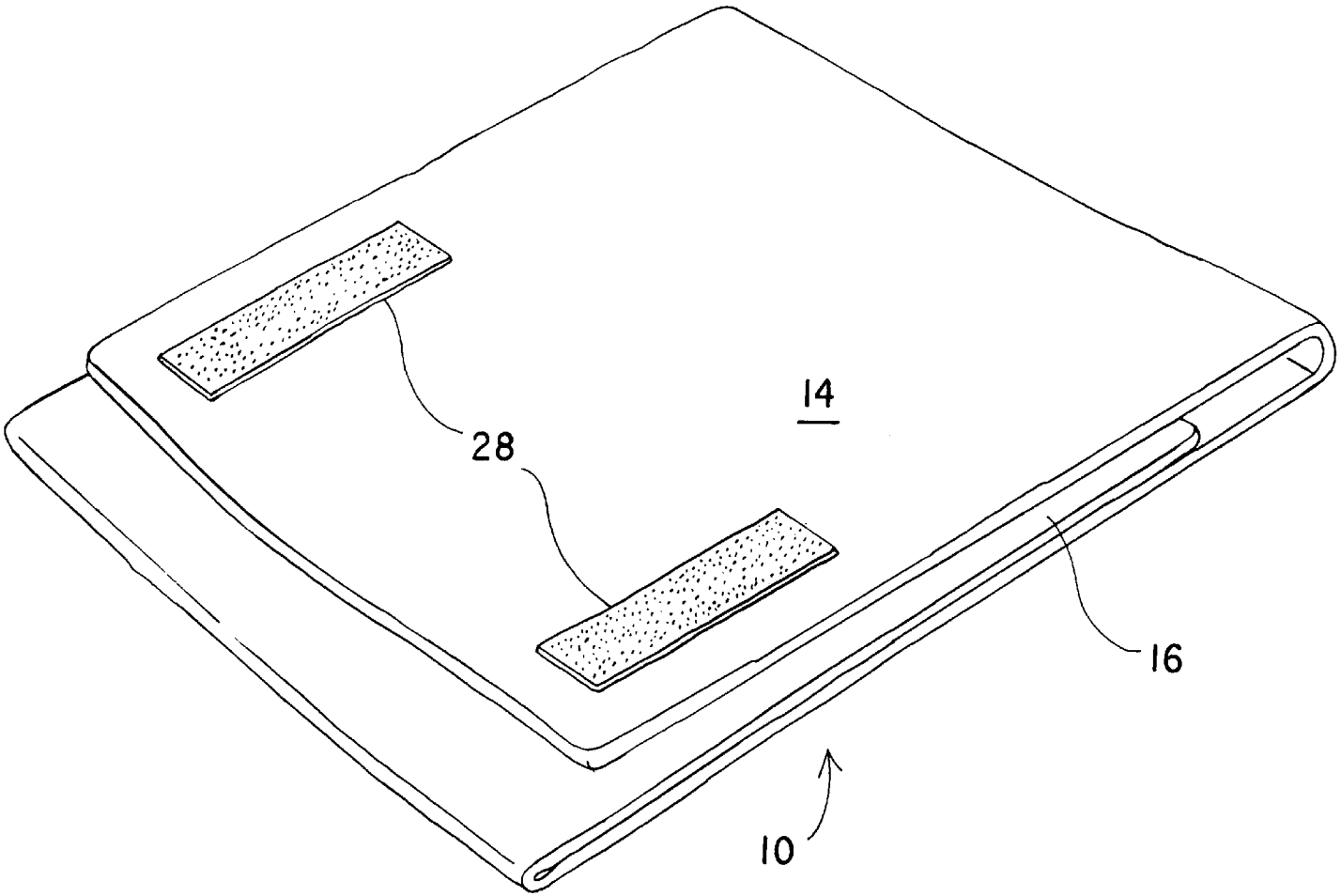
FIG. 4 is a perspective view of a travel pouch according to the present invention with the flap folded in a closed position.

A portion of the handle C extends from the open top of the pocket 12, so that the power cord B may be coiled and secured in the power cord retainer 25 on the inside face of the flap 14 for storage, preventing the power cord B from coming into contact with the heated barrel D, potentially melting insulation on the cord B. The flap 14 may be folded at the center line 16 into a closed position in which the flap 14 is secured to the pocket 12 by cooperation of fasteners 22 and 24, so that the pouch 10 presents a compact profile for storage in luggage, as shown in FIG. 4. When empty and folded as shown in FIG. 4, representative dimensions of the pouch 10 are about 11" long by 8.5" wide by 1" thick. The flap 14 covers the top of the pocket 12, preventing the heated appliance from becoming accidentally dislodged from the pocket 12, and preventing any foreign objects from entering the pocket 12 while the heated appliance is still warm, thereby preventing a fire hazard.

Figure 5:
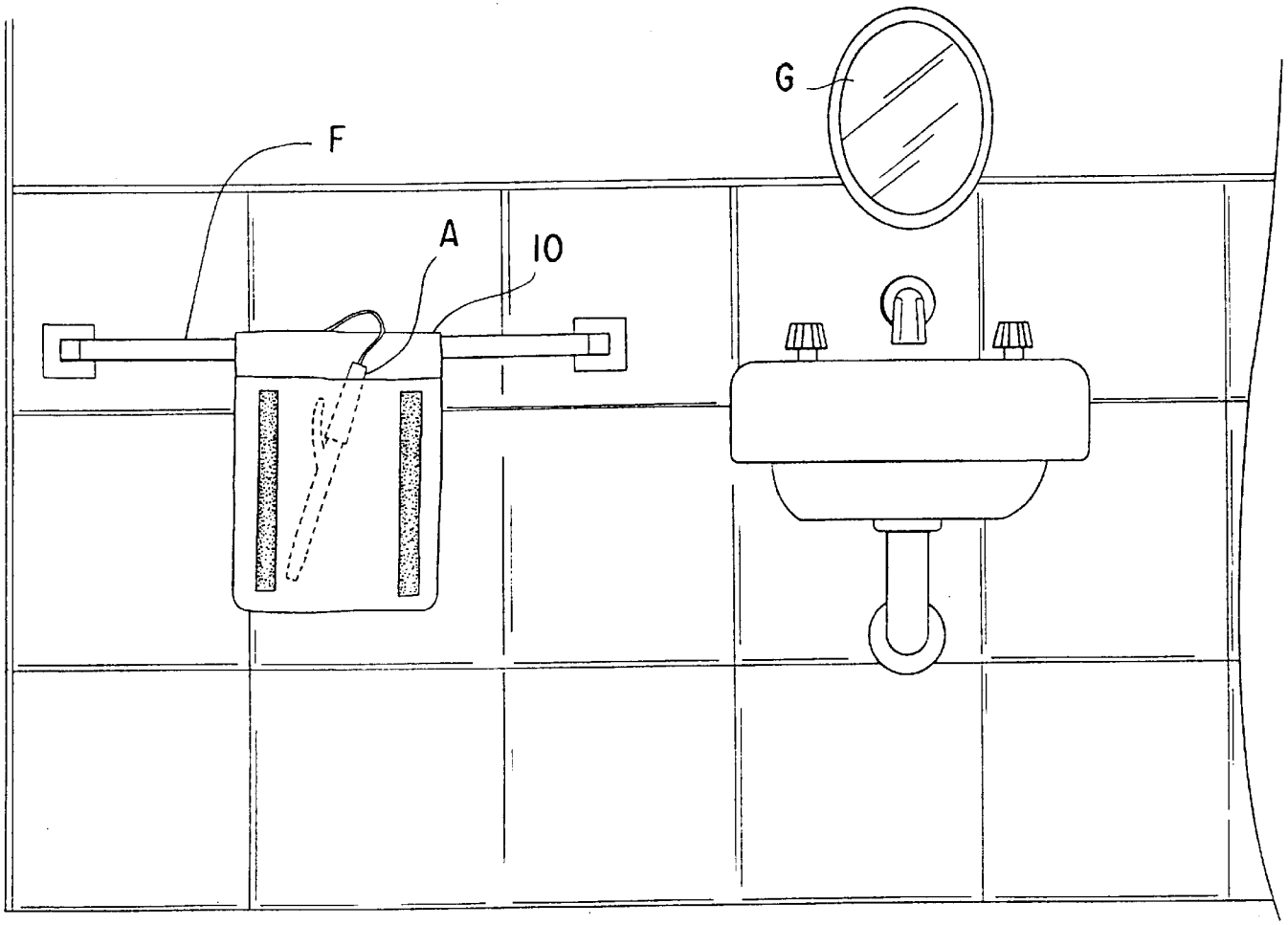
FIG. 5 is an environmental, front view of a travel pouch according to the present invention hanging from a towel bar.

As shown in FIG. 2, the pouch 10 may also be equipped with fasteners on the outer face 20 of the pocket 12 and the flap 14. Preferably the fasteners on the outer face 20 are also hook and loop fasteners, such as Velcro®, and may include a pair of spaced apart strips of hook material 26 extending longitudinally on the outer face of the pocket 12, and a corresponding pair of spaced apart strips of loop material 28 extending longitudinally on the outer face of the flap 28. The fasteners 26, 28 on the outer face of the pouch 10 permit the pouch 10 to be folded about the center line 16 360° from the closed position so that the pouch 10 may hung from a towel bar F, rod, or other support as shown in FIG. 5 in what may be termed a saddle position, the fasteners 26, 28 temporarily fastening the pouch 10 into a closed loop so that the pouch 10 may not accidentally slide off the bar F. The hook and loop fasteners 26, 28 allow the pouch 10 to be quickly set up for use in a convenient location, such as next to a hotel or motel mirror G, and quickly removed for transport in luggage.

Figure 3:
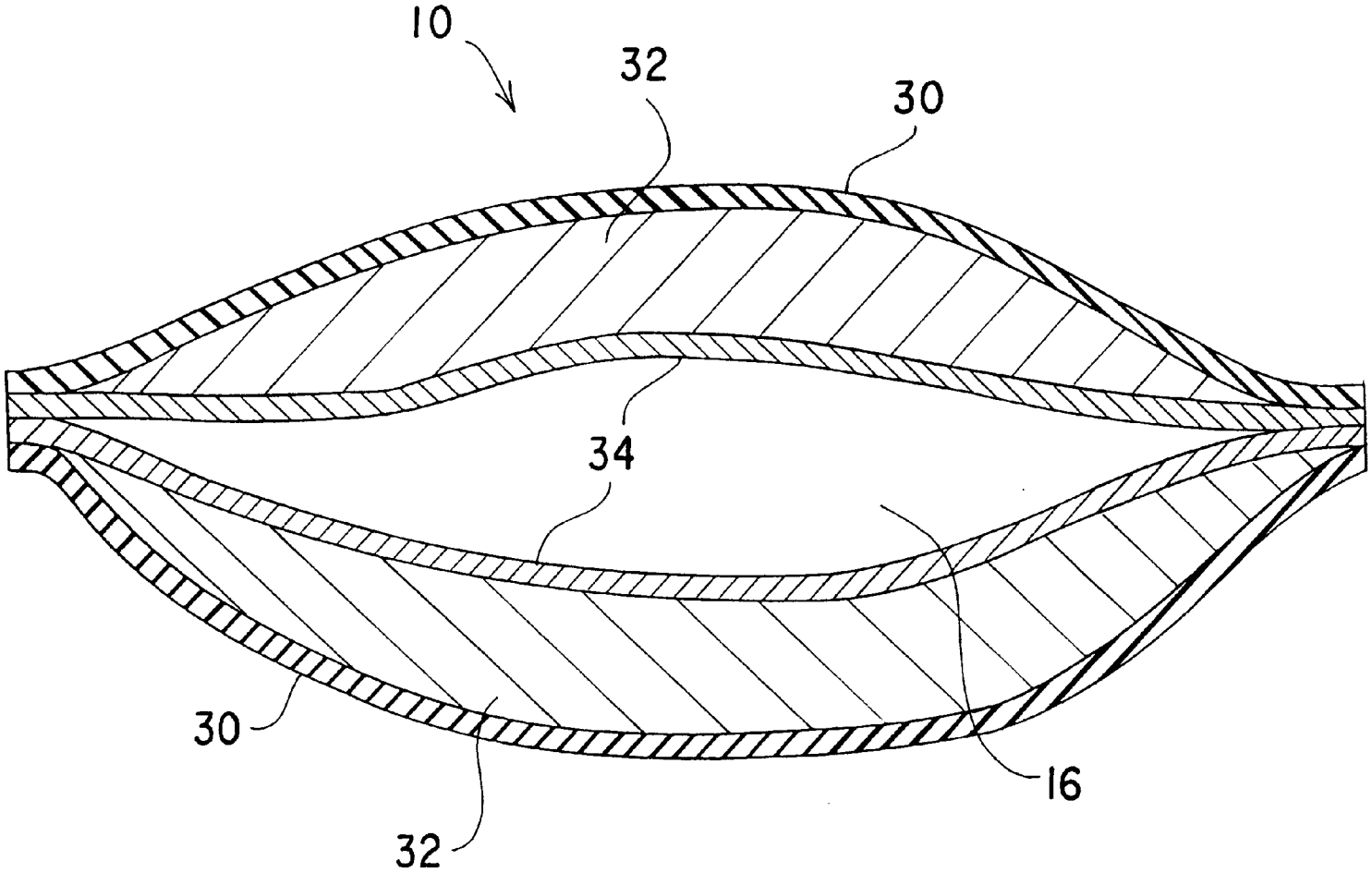
FIG. 3 is a section view along the line 3—3 of FIG. 2.

As shown in FIG. 3, the pouch 10 is constructed in three layers. The outer layer 30 is made from a flexible material, such as cotton, synthetic fabric, leather, and like material, selected for its aesthetic qualities. The inner layer 32 is made from a flexible fabric coated with a heat resistant material, such as silicone, able to withstand the heat generated by curling irons, travel irons, and similar heated appliances without degradation. Such fabric is used for ironing board covers, and is well known in the art. Between the outer 30 and inner 32 layers is a middle layer 34 of a heat resistant, thermally insulated batting material, such as that used in ironing board construction. The middle layer 34 may be thinned at the center line 16 to ensure that the pouch 10 is flexible enough to fold as described above. The outer layer 30 is permanently fastened to the inner layer 32 about its periphery, as by sewing, the middle layer 34 being enclosed between the two.

In making the pouch 10 the three layers 30, 32, 34 are assembled to form an elongated rectangular strip. A portion of the strip amounting to slightly less than one-third the length of the strip is folded back and permanently fastened, as by sewing, to the remaining two-thirds of the strip along the sides in order to define the substantially flat, flexible pocket 12, the inner layer 30 being on the inside of the pocket 12, and the outer layer 34 being on the outside of the pocket 12. The middle layer may be thinned to form a flexible center line 16 bisecting the pouch 10 defining a flap 14 substantially equal in length to the pocket 12 which may be folded to cover the pocket 12. The top of the pocket 12 is preferably between one and 1½ inches from the center line 16. Alternatively, the pocket 12 may be formed by fastening two separate rectangular strips of material together along a common bottom and opposing sides.

It is to be understood that the present invention is not limited to the embodiments described above, but encompasses any and all embodiments within the scope of the following claims.

I claim:

1. A travel pouch for heated appliances, comprising:

a) a pocket having an open top, a front face, and a rear face;

b) a flap integral with said pocket, the flap being foldable about a center line between said pocket and the flap;

c) a first fastening means for temporarily fastening said flap to the front face of said pocket, said flap being folded over said pocket in order to cover said pocket; and d) a second fastening means for temporarily fastening said flap to the rear face of said pocket, said flap being folded about the center line so that said flap is parallel to and abutting the rear face of said pocket, in order to define a closed loop adapted for suspending said pouch from a support rod.

2. The travel pouch for heated appliances according to claim 1, wherein said pouch is made from a material comprising three layers, including:

a) an outer layer made from a flexible material;

b) an inner layer made from a flexible fabric coated with a heat resistant material; and c) a middle layer made from a heat resistant, thermally insulated batting;

d) wherein said outer layer is permanently fastened to said inner layer, the middle layer being enclosed between said outer and inner layers; and e) wherein said inner layer forms a lining for the inside of said pocket.

3. The travel pouch for heated appliances according to claim 1, wherein said first fastening means comprises hook and loop fastening material.

4. The travel pouch for heated appliances according to claim 1, wherein said first fastening means comprises a pair of spaced apart strips of hook and loop material extending longitudinally on the front face of said pocket and a pair of spaced apart strips of hook and loop material extending longitudinally attached to said flap, the strips on the front face of said pocket and the strips attached to said flap cooperating to temporarily fasten said flap in a closed position over said pocket.

5. The travel pouch for heated appliances according to claim 1, wherein said second fastening means comprises hook and loop fastening material.

6. The travel pouch for heated appliances according to claim 1, wherein said second fastening means comprises a pair of spaced apart strips of hook and loop material extending longitudinally on the rear face of said pocket and a pair of spaced apart strips of hook and loop material extending longitudinally attached to said flap, the strips on the rear face of said pocket and the strips attached to said flap cooperating to temporarily fasten said flap in a saddle position adapted for hanging said pouch on a wall mounted support rod.

7. The travel pouch for heated appliances according to claim 1, further comprising a power cord retaining means for retaining a power cord of a heated appliance outside of said pocket.

8. The travel pouch for heated appliances according to claim 7, wherein said power cord retaining means comprises an elastic strap fixedly attached to said flap.

9. The travel pouch for heated appliances according to claim 1, wherein said pocket has a length of about 9.5 inches and a width of about 8.5 inches, being adapted for receiving at least two curling irons.

10. A travel pouch for heated appliances, comprising a generally rectangular strip of material having:

a) an outer layer made from a flexible material;

b) an inner layer made from a flexible fabric coated with a heat resistant material; and c) a middle layer made from a heat resistant, thermally insulated batting;

wherein said outer layer is permanently fastened to said inner layer, the middle layer being enclosed between said outer and inner layers, a portion of said strip having a length slightly less than one-third the total length of the strip being folded back and permanently fastened to the remaining two-thirds of the strip along the sides of the strip in order to define a substantially flat pocket having an open top, a front face, and a rear face, said middle layer being thinned in order to form a flexible center line defining a flap substantially equal in length to said pocket, said flap being foldable in order to cover the open top of said pocket, said inner layer lining the inside of said pocket, the travel pouch further comprising a second fastening means for temporarily fastening said flap to the rear face of said pocket, said flap being folded about the center line so that said flap is parallel to and abutting the rear face of said pocket, in order to define a closed loop adapted for suspending said pouch from a support rod.

11. The travel pouch for heated appliances according to claim 10, further comprising a first fastening means for temporarily fastening said flap to the front face of said pocket, said flap being folded over said pocket in order to cover said pocket.

12. The travel pouch for heated appliances according to claim 11, wherein said first fastening means comprises a pair of spaced apart strips of hook and loop material extending longitudinally on the front face of said pocket and a pair of spaced apart strips of hook and loop material extending longitudinally attached to said flap, the strips on the front face of said pocket and the strips attached to said flap cooperating to temporarily fasten said flap in a closed position over said pocket.

13. The travel pouch for heated appliances according to claim 10, wherein said second fastening means comprises a pair of spaced apart strips of hook and loop material extending longitudinally on the rear face of said pocket and a pair of spaced apart strips of hook and loop material extending longitudinally attached to said flap, the strips on the rear face of said pocket and the strips attached to said flap cooperating to temporarily fasten said flap in a saddle position adapted for hanging said pouch on a wall mounted support rod.

14. The travel pouch for heated appliances according to claim 10, further comprising a power cord retaining means for retaining a power cord of a heated appliance outside of said pocket.

15. The travel pouch for heated appliances according to claim 14, wherein said power cord retaining means comprises an elastic strap fixedly attached to said flap.

16. The travel pouch for heated appliances according to claim 10, wherein said pocket has a length of about 9.5 inches and a width of about 8.5 inches, being adapted for receiving at least two curling irons.

* * * * *